United States Patent [19]

May

[11] Patent Number: 4,811,046

[45] Date of Patent: Mar. 7, 1989

[54] TRI-LEVEL HIGHLIGHT COLOR PRINTING APPARATUS WITH CYCLE-UP AND CYCLE-DOWN CONTROL

[75] Inventor: Jerome E. May, Rochester, N.Y.

[73] Assignee: Xerox Corporation, Stamford, Conn.

[21] Appl. No.: 78,743

[22] Filed: Jul. 28, 1987

[51] Int. Cl.[4] ..... G03G 15/01

[52] U.S. Cl. ..... 355/4; 355/3 DD; 355/14 D; 430/45

[58] Field of Search ..... 355/4, 3 DD, 14 D; 118/657–658, 652, 647; 430/45, 122

[56] References Cited

U.S. PATENT DOCUMENTS

| | | | |
|---|---|---|---|
| 3,392,432 | 7/1968 | Naumann | 29/110 |
| 3,640,248 | 2/1972 | Nielander | 118/658 |
| 3,662,395 | 5/1972 | Doi et al. | 346/74 |
| 3,709,713 | 1/1973 | Turner | 117/17.5 |
| 3,940,272 | 2/1976 | Davidson | 96/1.4 |
| 4,053,218 | 10/1977 | Mikolas | 355/15 |
| 4,078,929 | 3/1978 | Gundlach | 96/1.2 |
| 4,352,552 | 10/1982 | Stange | 355/4 |
| 4,761,672 | 8/1988 | Parker et al. | 355/14 D |

OTHER PUBLICATIONS

U.S. Ser. No. 844,681, Filed 10/25/77, Development System, Green et al.

U.S. Ser. No. (D/85176), Copending Application, Raaped Developer Biases, Delmer G. Parker et al.

Xerox Disclosure Journal, vol. 12, Mar./Apr., 1987.

*Primary Examiner*—Arthur T. Grimley

*Assistant Examiner*—J. Pendegrass

[57] ABSTRACT

Undesirable transient development conditions that occur during start-up and shut-down in a tri-level xerographic system when the developer biases are either actuated or de-actuated are obviated by the provision of developer apparatuses having rolls which are adapted to be rotated in a predetermined direction for preventing developer contact with the imaging surface during periods of start-up and shut-down. The developer rolls of a selected developer housing or housings can be rotated in a the contact-preventing direction to permit use of the tri-level system to be utilized as a single color system or for the purpose of agitating developer in only one of the housings at time to insure internal triboelectric equilibrium of the developer in that housing.

23 Claims, 4 Drawing Sheets

TRI-LEVEL HIGHLIGHT COLOR PRINTING APPARATUS WITH CYCLE-UP AND CYCLE-DOWN CONTROL

BACKGROUND OF THE INVENTION

This invention relates generally to the rendering of latent electrostatic images visible using multiple colors of dry toner or developer and more particularly to a developer apparatus and its method of operation wherein the transient development stress problems related to the xerographic start-up and shut-down of a single-pass tri-level xerographic engine as well as other problems are overcome.

The invention can be utilized in the art of xerography or in the printing arts. In the practice of conventional xerography, it is the general procedure to form electrostatic latent images on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The concept of tri-level xerography is described in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level xerography as taught by Gundlach, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged area development, i.e. CAD) stays at the full photoreceptor potential ($V_{cad}$ or $V_{ddp}$), the other image is exposed to discharge the photoreceptor to its residual potential, i.e. $V_{dad}$ or $V_c$ (typically 100 v) which corresponds to discharged area images that are subsequently developed by discharged-area development (DAD). The background areas are exposed such as to reduce the photoreceptor potential to halfway between the $V_{cad}$ and $V_{dad}$ potentials, (typically 500 v) and is referred to as $V_{white}$ or $V_w$. The CAD developer is typically biased about 100 v closer to $V_{cad}$ than $V_{white}$ (about 600 v), and the DAD developer system is biased about 100 v closed to $V_{dad}$ than $V_{white}$ (about 400 v).

In the case of a tri-level xerographic engine start-up, if, for example, the CAD developer bias is switched on prior to the arrival of the sensitized and properly exposed photoreceptor, the large uncharged area of the photoreceptor would generate a large cleaning field of the magnitude of the developer bias voltage (600 v). In the presence of such a large cleaning field, developer beads would tend to be preferentially attracted to the photoreceptor, leading to a condition known as bead carry-out. The high cleaning field would be removed only with the arrival of a properly charged photoreceptor at the $V_{white}$ potential.

Conversely, if the photoreceptor charged to $V_{white}$ arrives at the CAD developer prior to the application of the developer bias voltage, the photoreceptor potential acts as a large solid-area image having a significant development potential ($V_{white}$, 500 v) to the toner particles, carrying out much toner from the developer housing, contributing to machine dirt and subsequent reliability problems, with the possibility of overloading the cleaner, and, because the development is carrying out toner faster than the developer system can replenish the carrier beads, also possibly causing a bead carry-out problem.

The case of DAD developer under similar conditions causes high toner carryout if the bias (400 v) is applied prior to the arrival of the photoreceptor at the $V_{white}$ potential, and possible bead carryout if the bias is applied subsequent to the arrival of $V_{white}$.

The foregoing and other problems are solved by my invention which includes the provision of developer structure comprising a plurality of rolls adapted to be rotated in one direction for developing latent images and in the reverse direction in order to remove the developer from the development zone.

Removal of developer from the development zone for various reasons is taught in the prior art. For example:

U.S. Pat. No. 3,940,272 granted to James R. Davidson on Feb. 24, 1976 discloses a method of developing electrostatic latent images in plural colors which comprises a separate developer structure for each color. As noted in column 6, lines 31–36, once the complete image recorded on the photoconductive surface has passed the first development zone development action msut be terminated in order to preclude intermingling of the different color developers used for the three different images developed. To effect such termination, rotation of a paddle wheel, transport roll and a developer roll comprising the development structure is stopped. This permits that development housing to pivot away from the photoconductive surface so that the developer therein ceases contact with the photoconductive surface.

U.S. Pat. No. 3,709,713 granted to L. H. Turner on Jan. 9, 1973 discloses a magnetic developer system wherein the magnet of a magnetic brush roll is pivotally displaced away from a photoreceptor such that the developer carried thereby does not develop the image on the photoreceptor. The purpose of this arrangement is to eliminate unwanted development of charged but non-imaged areas such as interdocument areas in an automatic xerographic machine having solid area capabilities.

U.S. patent application, Ser. No. 844,681, cited in U.S. Pat. No. 4,352,552 and now abandoned, discloses, in a three-pass color copier, the reverse rotation of a developer roll as well as the other members of the development device for effecting the removal of the developer from the developer roll and, therefore, away from the latent image so that an image of one color is not contacted by developer of a second developer.

In U.S. Pat. No. 4,053,218, it is stated that U.S. Pat. No. 3,570,453 and 3,575,139 teach the articulation of a blade into contact with the developer roll to prevent developer mix from being moved into the development zone.

U.S. Pat. No. 3,662,395 issued to Doi et al on May 9, 1972 discloses the reverse rotation of a developer roll and as set forth in column 9, lines 65–72, a cooperating doctor plate scrapes the powder from the magnet drum.

Another invention assigned to the same assignee as the instant invention and disclosed in U.S. patent application, Ser. No. 78,750 relates to the use of programmable power supplies and a controller to minimize the electrical stress on the developer in contact with the photoreceptor during start-up and shut-down.

U.S. Pat. No. 3,392,432 assigned to Azoplate Corp. discloses a magnet roller wherein a magnetizing system and its surrounding shell are adapted to be rotated together while occupying different relative angular positions relative to each other. In one relative position, developer mix is attracted to the roller and in the other relative position it is not so attracted.

Xerox Disclosure Journal, Vol. 12 Number 2 dated March/April 1987 discloses a rapid cut-off developer system for highlight color wherein a shield can be selectively interposed between the developer and the charge retentive surface in order to collapse the magnetic field of the developer structure for removing developer from contact with the charge retentive surface.

It is of interest to note that, due to the finite width of the developer zone of a single roll, it is not possible to avoid the aforementioned conditions during start-up or shut-down with hardware that can provide only step transitions (switch on/switch off) in developer bias potentials or photoreceptor potentials.

BRIEF SUMMARY OF THE INVENTION

Briefly, my invention provides a development apparatus which includes one or more magnetic brush developer rolls and drive therefor, developer metering apparatus and control system which are adapted to rotate the developer rolls in the direction opposite of their normal rotation during development and, while rotating in this opposite direction, cause the developer material to leave contact with the photoreceptor and remain such a distance away that when the periods of high electrical stress occur during start-up and shut-down of the machine, the developer is completely removed from regions of the developer zone subject to such detrimental electrical stress.

The advantage of this type of system is that it completely eliminates, rather than just minimizes, the electrical stress on the developer materials during the electrical transient periods of start-up and shut-down described previously.

Additionally, in the case of trilevel xerography, it provides a means for developing images solely of one color (polarity) or the other, without having to subject the latent image to contact with developer materials from both developer systems, if only one type or color of development is desired.

Additionally, certain benefits can be derived from agitating one developer material during start-up without agitating the other. This agitation can take place against an appropriately charged but unimagined photoreceptor (i.e. areas of the photoreceptor charged to $V_{white}$). Certain developer materials, after periods of idleness, have a tendency to initially develop objectionable levels of background (fog) until the internal triboelectric equilibrium is restored through a period of agitation. It is certainly possible, using principles of this invention, to selectively agitate one developer or the other to obtain the best triboelectric state of both materials. This would involve bringing materials in contact with a suitably charged (such as $V_{white}$, or perhaps some other suitable conditioning potential) photoreceptor having no image information impressed upon it.

In general, magnetic brush development material transport requires a balancing of magnetic forces against gravitational, electrical, and frictional forces in order to accomplish a series of tasks. The magnetic forces must:

(1) lift the developer material from the sump to the developer roll against the force of gravity
(2) cause the developer to attach itself to the rotating shell in such a way as to cause it to rotate with the shell
(3) hold the developer material on the developer roll shell as it is metered
(4) transport the metered developer material through the development zone, holding the carrier beads on the developer roll as the toner is removed from the carrier by electrostatic image forces
(5) transport the exhausted developer away from the development zone
(6) return the exhausted developer to the sump for replenishment.

In the case of multiple-roll developer systems, item (5) includes the task of transporting developer material from one roll to the subsequent roll.

The means of removing developer from the development zone ('clearing') places an additional constraint on the system. When the mechanical drive to the developer housing is reversed, the magnetic forces in the system must be arranged so as to (1) prevent the lifting of developer from the sump onto the roll as the roll rotates opposite its usual direction
(2) transport any developer material which is on the roll back through the development zone and remove developer material from any possibility of interaction with the photoreceptor
(3) transport the developer back to the sump along the path formerly used to bring material from the sump through the metering gap
(4) in the case of a multiple roll developer system, the magnets which transport the material from one roll to a subsequent roll must now perform that task with the rolls rotating in the direction opposite that of development. Any material which might become trapped by magnetic forces between two developer rolls must not be allowed to form bristles or any other structures which may contact the photoreceptor.

Item (3) requires that the metering gap be arranged such that, when the developer roll rotates in the normal development direction, the metering task is performed correctly, but when the roll rotates in the 'clearing' direction, there is adequate volume to transport the developer back to the sump without either spilling out of the developer housing or jamming up against the photoreceptor.

It has been determined that in order to satisfy the aforementioned constraints when using multiple rolls, the rolls must have predetermined diameters, be spaced apart a predetermined distance and possess a predetermined magnetic field profile. In accordance with the present invention, the aforementioned constraints are met, in the case of a plural roll development system, by the provisions of a plurality of magnetic roll structures supported for rotation in two directions and spaced apart such that developer is satisfactorily transported from one roll to the next while the rolls are rotated in the development direction and and such that the developer material can be effectively removed from contact with the charge retentive surface when rotated in the opposite direction.

DETAILED DESCRIPTION OF THE PREFERRED EMBODIMENT OF THE INVENTION

Figure 1A:
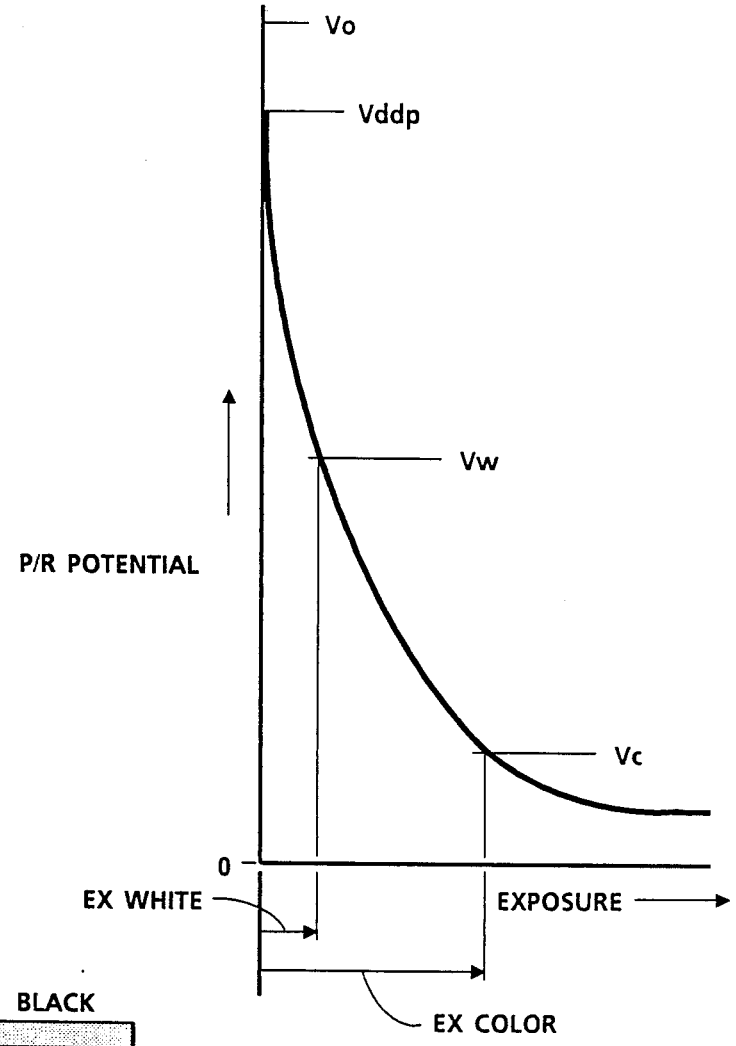
FIG. 1*a* is a plot of photoreceptor potential versus exposure illustrating a tri-level electrostatic latent image.
Figure 1B:
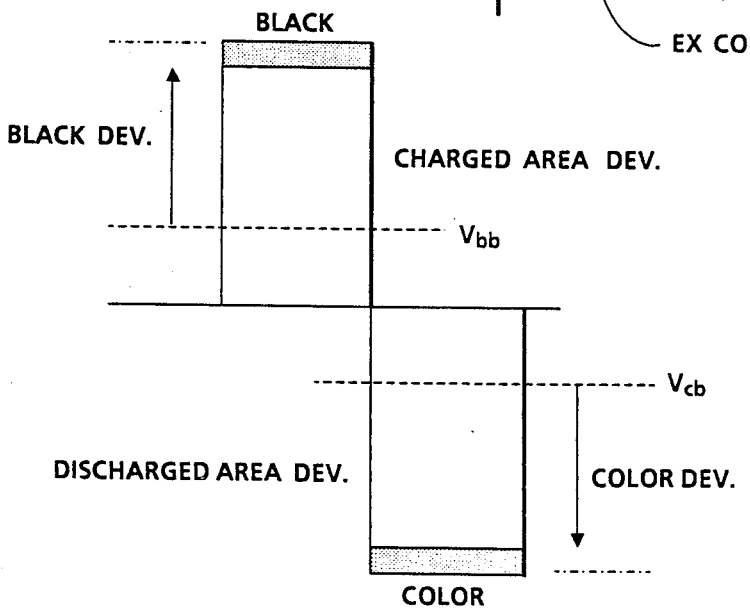
FIG. 1*b* is a plot of photoreceptor potential illustrating single-pass, highlight color latent image characteristics.

For a better understanding of the concept of tri-level imaging, a description thereof will now be made with reference to FIGS. 1*a* and 1*b*. FIG. 1*a* illustrates the tri-level electrostatic latent image in more detail. Here $V_o$ is the initial charge level, $V_{ddp}$ the dark discharge potential (unexposed), $V_w$ the white discharge level and $V_c$ the photoreceptor residual potential (full exposure).

Color discrimination in the development of the electrostatic latent image is achieved by passing the photoreceptor through two developer housings in tandem, which housings are electrically biased to voltages which are offset from the background voltage $V_w$, the direction of offset depending on the polarity or sign of toner in the housing. One housing (for the sake of illustration, the first) contains developer with black toner having triboelectric properties such that the toner is driven to the most highly charged ($V_{ddp}$) areas of the latent image by the electric field between the photoreceptor and the development rolls biased at $V_{bb}$ ($V_{black\ bias}$) as shown in FIG. 1*b*. Conversely, the triboelectric charge on the colored toner in the second housing is chosen so that the toner is urged towards parts of the latent image at residual potential, $V_c$, by the electric field existing between the photoreceptor and the development rolls in the second housing at bias voltage $V_{cb}$($V_{color\ bias}$).

Figure 2:
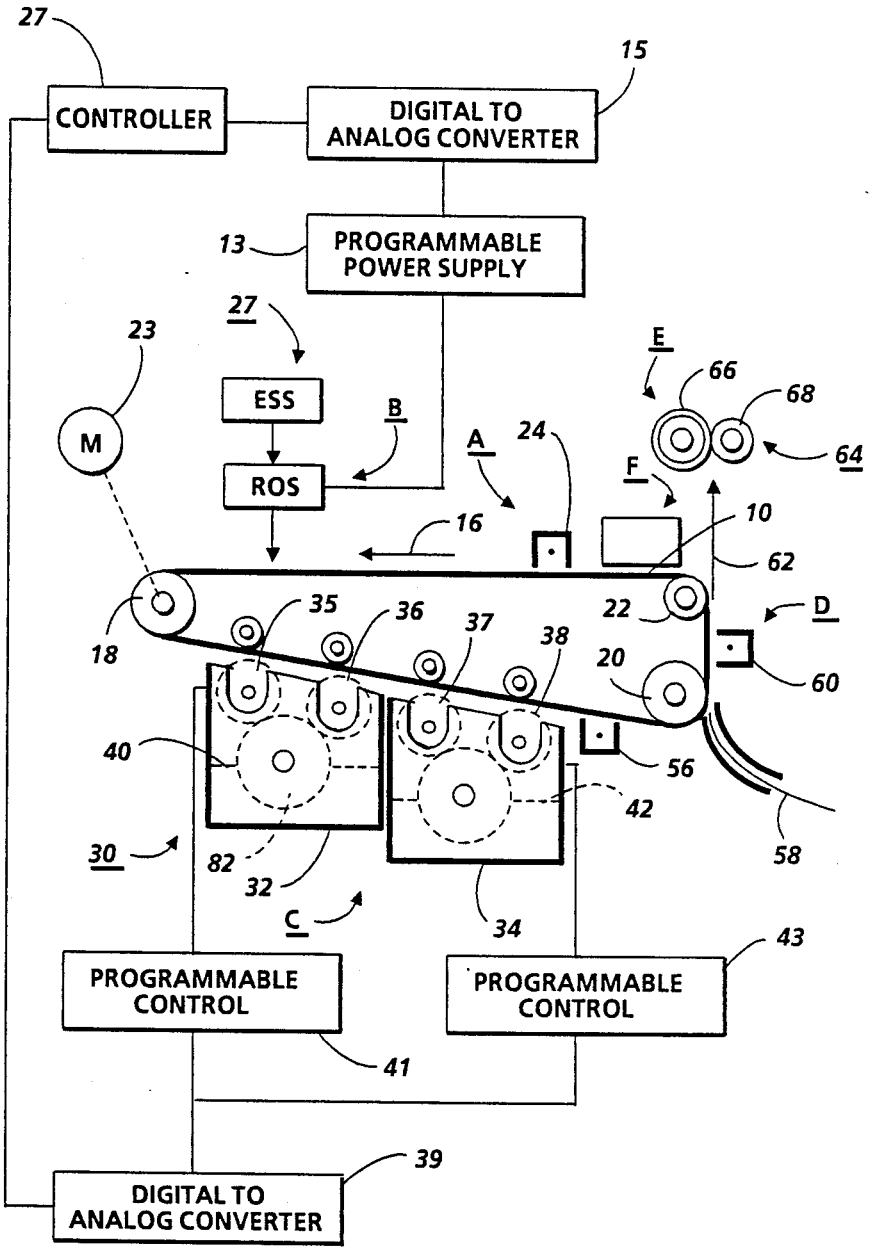
FIG. 2 is a schematic illustration of a printing apparatus incorporating the inventive features of our invention.

As shown in FIG. 2, a printing machine incorporating my invention may utilize a charge retentive member in the form of a photoconductive belt 10 consisting of a photoconductive surface and an electrically conductive substrate and mounted for movement past a charging station A, an exposure B, developer stations C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_o$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). The ROS output is set via a programmable power supply 26 which is driven by means of a controller 27 via a digital to analog converter 28. Alternatively, the ROS could be replaced by a conventional xerographic exposure device.

The photoreceptor, which is initially charged to a voltage $V_o$, undergoes dark decay to a level $V_{ddp}$. When exposed at the exposure station B it is discharged to $V_w$ imagewise in the background (white) image areas and to $V_c$ which is near zero or ground potential in the highlight (i.e. color other than black) color parts of the image. See FIG. 1*a*.

At development station C, a magnetic brush development system, indicated generally by the reference numeral 30 advances developer materials into contact with the electrostatic latent images. The development system 30 comprises first and second developer structures including housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers 38 advances its respective developer material into contact with the latent image. Each developer roller pair forms a brush-like structure comprising toner particles which are attracted therefrom by the latent electrostatic images on the photoreceptor.

Appropriate developer biasing is accomplished via programmable power controls 41 and 43 electrically connected to respective developer housings 32 and 34 and the controller 27, connection of the controller to the developer housings being via a digital to analog converter 39. An appropriate program stored in fixed memory of the controller for the developer housing, applied through a digital-to-analog converter and a programmable power supply, will cause the developer rolls, at the appropriate times, to rotate in one direction to effect image development or in the opposite direction for causing the developer to cease contact with the photoreceptor. For example, during cycle-up and cycle-down the rolls are made to rotate in the direction for ceasing developer contact with the photoreceptor. Rotation in the developing direction is accomplished from the time when cycle-up has been completed to just prior to cycle-down. Also during cycle-up, a program stored in the controller 27 serves to vary the output of the light source (ROS) such that the photoreceptor or charge retentive member is uniformly discharged to a first predetermined voltage level. The voltage level on the photoreceptor is then allowed to increase above the first predetermined voltage level by decreasing the intensity of the light source. Developer contact with the photoreceptor is precluded until the photoreceptor voltage level reaches a second predetermined voltage level by virtue of decreasing the light intensity. Developer contact with the photoreceptor is precluded by rotating the developer rolls in the appropriate direction.

Other suitable programs stored in the fixed memory of the controller may be used for ensuring proper toner/carrier triborelationships by causing rotation of the developer rolls in the developing direction at the time when this can be accomplished without actually developing images on the photoreceptor.

Color discrimination in the development of the electrostatic latent image is achieved by passing the photoreceptor past the two developer housings 32 and 34 in a single pass with the magnetic brush rolls 35, 36, 37 and 38 electrically biased to voltages which are offset from the background voltage $V_w$, the direction of offset depending on the polarity of toner in the housing. One housing e.g. 32 (for the sake of illustration, the first) contains developer with black toner 40 having triboelectric properties such that the toner is driven to the most highly charged ($V_{ddp}$) areas of the latent image by the electrostatic field (development field) between the photoreceptor and the development rolls biased at $V_{bb}$ as shown in FIG. 1*b*. Conversely, the triboelectric charge on colored toner 42 in the second housing is chosen so that the toner is urged towards parts of the latent image at residual potential, $V_c$ by the electrostatic field (development field) existing between the photoreceptor and the development rolls in the second housing at bias voltages $V_{cb}$.

In prior art tri-level xerography, the entire photoreceptor voltage difference ($|V_{ddp}-V_c|$, as shown in FIG. 1*a*) is shared equally between the charged area development (CAD) and the discharged area development (DAD). This corresponds to $\approx$800 volts (if a realistic photoreceptor value for $V_{ddp}$ of 900 volts and a residual discharge voltage of 100 volts are assumed). Allowing an additional 100 volts for the cleaning field in each development housing ($|V_{bb}-V_{white}|$ or $|V_{white}-V_{cb}|$) means an actual development contrast voltage for CAD of $\approx$300 volts and an $\approx$ equal amount for DAD. In the foregoing case the 300 volts of contrast voltage is provided by electrically biasing the first developer housing to a voltage level of approximately 600 volts and the second developer housing to a voltage level of 400 volts.

A sheet of support material 58 is moved into contact with the toner image at transfer station D. The sheet of support material is advanced to transfer station D by conventional sheet feeding apparatus, not shown. Preferably, sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a pre-transfer corona discharge member 56 is provided to condition the toner for effective transfer to a substrate using corona discharge.

Transfer station D includes a corona generating device 60 which sprays ions of a suitable polarity onto the backside of sheet 58. This attracts the charged toner powder images from the belt 10 to sheet 58. After transfer the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and back-up roller 68. Sheet 58 passes between fuser roller 66 and a back-up roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F.

Subsequent to cleaning, a discharge lamp (not shown) floods the photoconductive surface with light to dissipate any residual electrostatic charge remaining prior to the charging thereof for the successive imaging cycle.

In accordance with the present invention, the developer roll pairs 35,36 and 37,38 are supported for rotation both clockwise and counter clockwise as viewed in FIG. 2. As noted hereinbefore, reverse rotation of the rollers effects removal of the developer materials from contact with the photoreceptor 10 during certain periods of operation.

Each of the developer roll structures 35 to 38 comprises a generally cylindrical, magnetically loaded rubber member mounted on an aluminum core or cylinder and an outer rotatable shell.

Figure 3:
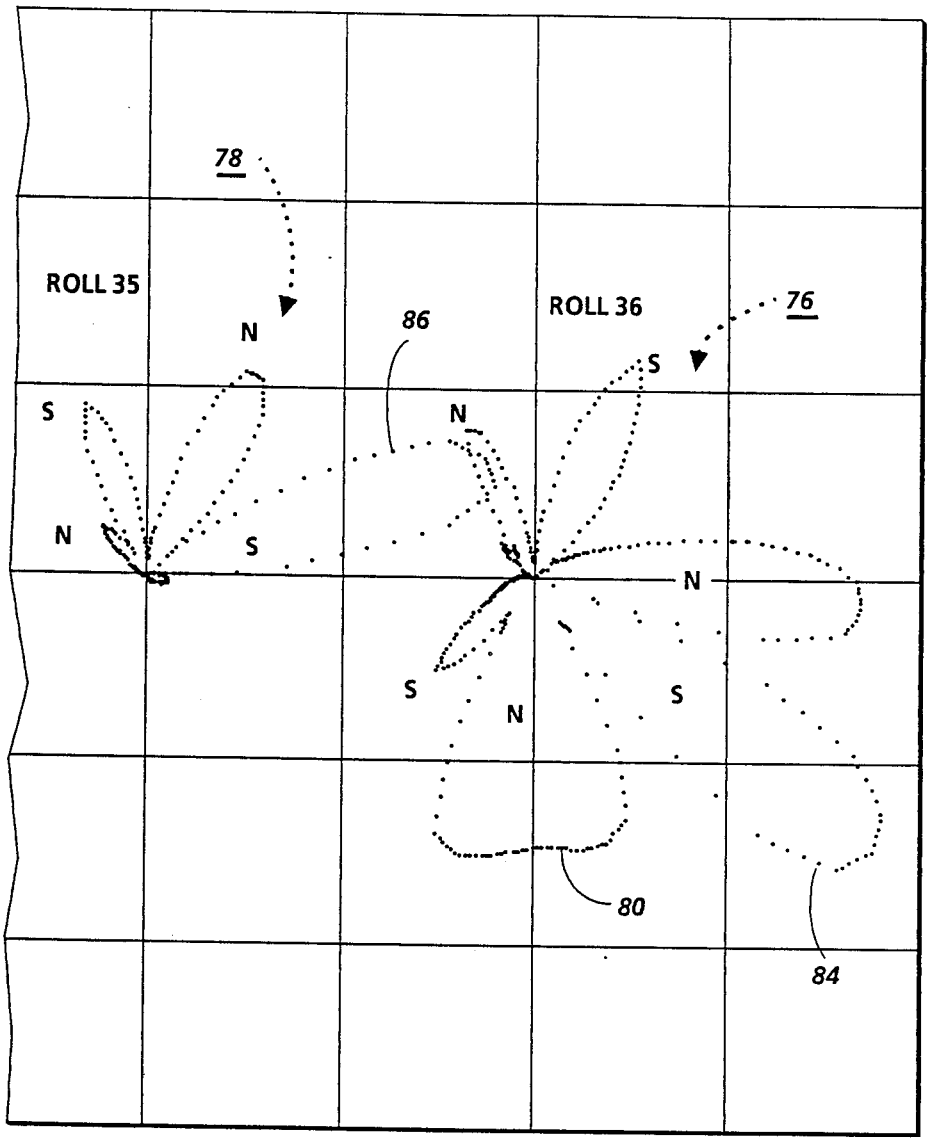
FIG. 3 is the radial magnetic force diagram for a pair of magnetic developer rolls incorporated in an embodiment of the invention.
Figure 4:
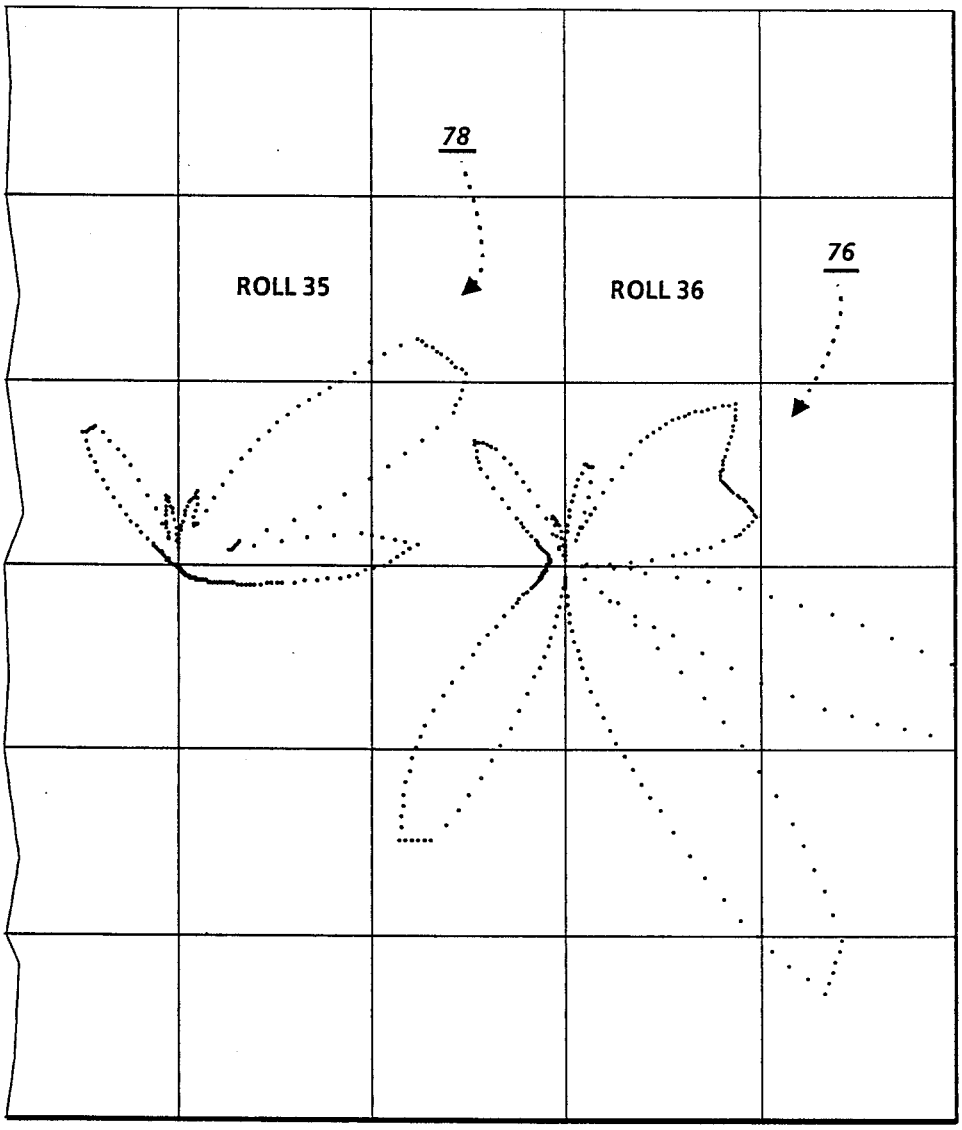
FIG. 4 is the tangential magnetic force diagram for the pair of rolls for which the diagram of FIG. 3 is depicted.

FIGS. 3 and 4 depict the radial and tangential components, respectively, of developer rolls 35,36 or 36,37. The following description is made with reference to the roll pair 35,36, by way of example. The description is equally applicable to rolls 36,37. Magnetic poles are designated N (north) or S (south). The magnetic fields are plotted around the central axis of a two-roll magnetic brush development system such as the one comprising rolls 35,36. For a multiple roll development system comprising more than two rolls, roll 36 is replicated. The rolls are driven synchronously in this example, although it is also possible to have independent drive mechanisms for each roller.

The development system additionally consists of a sump, or reservoir, of magnetic developer material, and optionally a mixing system, paddle wheel, or other apparatus to maintain the developing properties of the material in the sump. The developer rolls are rotating non-magnetic cylinders having roughened or longitudinally corrugated surfaces to urge the developer along by frictional forces around fixed internal magnets. The rolls are driven synchronously in this example; it is also possible to have independent drive mechanisms for each roller.

During the development process of the system which I describe, the direction of rotation of the shell around either fixed magnet is counter-clockwise. During the clearing step, the direction is clockwise. However, the system can also be configured to develop in the clockwise direction, and clear in the counterclockwise direction, with no compromise in performance, depending on the desired properties of the development system with respect to the direction of the photoreceptor (i.e., against-mode or with-mode development).

In the case described, the photoreceptor is located above the development rolls. The developer materials are transported from right to left from the sump to roll 36, to Roll 35, back to sump.

A broad radial pole 80 of roll 36 (FIG. 3) positioned at 6 o'clock acts to lift magnetic developer material from the sump or housing 32. The combination of tangential and radial fields starting with radial field 84 transports the developer material along the surface of the developer roll until about the 10 o'clock position of roll 36. At that point, the strong radial pole of roll 35 attracts the developer from roll 36 to roll 35, overcoming the force of gravity, which tends to pull the developer material back into the sump.

Once attracted to roll 35 by the radial magnetic force, the combination of radial and tangential magnetic forces of roll 35 keep the developer on the rotating shell through the development zone of roll 35. Weak radial magnetic forces at the 9 o'clock position of roll 35 allow the developer to be released and return to the sump.

In order to clear the developer zone, the counterclockwise rotation of the developer shells is stopped. The shells are both rotated clockwise to clear the magnetic developer material from the development zone of both rollers.

The clearing action is accomplished as follows. As the developer drive has stopped its counterclockwise rotation, no further developer is picked up from the developer sump onto roll 36. As the rolls rotate clockwise, material is transported along the surface of the rotating shells as in the counterclockwise case, with the following important exceptions.

Between rolls 36 and 35, the strong radial pole 86 of roll 35 at the 3 o'clock tends to hold the developer material onto the clockwise-rotating shell, past the influence of the weak radial pole on roll 36 at the 9 o'clock position. Developer is constrained to roll 35, and is unable to transfer to roll 36. Consequently, developer material is transported to a region of weak magnetic field and, under gravity, is returned to the sump.

Similarly, the magnetic fields of roll 36 keep the developer material attached to the rotating shell through the broad 'pickup' pole 80 at 6 o'clock. However, as there are no (or very weak) magnetic forces beyond the pickup pole 80 (between 6 o'clock and 8 o'clock positions), the developer material is urged past the regime of the holding force of the magnetic pole by frictional forces of the corrugated rotating shell, and returns to the sump. Some developer material may remain on the shell in the vicinity of the pickup pole; however, it is of no consequence, as it is completely removed from the influence of electrostatic forces in the development zone.

While the component 86 has to have a relatively strong field force for gaining control of the developer during development it must also be capable of preventing giving up control of the developer to the roll 36 when the rolls are rotated in the reverse direction. This is so that the developer can be quickly and effectively removed from contact with the photoreceptor returned to the sump via the space between the developer rolls. Thus, the component 86 is like a diode or uni-directional device, in that, it functions to move or effect movement of developer in only one direction. Typical rolls used in my invention have an outer diameter of 63 millimeters and have a center to center spacing of 70 millimeters. The space between such rolls was 7 millimeters.

What is claimed is:

1. A method for producing plural-color images, said method including the steps of:

uniformly charging a charge retentive member;

actuating a light source capable of uniformly discharging said charge retentive member and selectively discharging said charge retentive member in accordance with information to be produced;

using said light source, uniformly discharging said charge retentive member to a first predetermined voltage level;

decreasing the intensity of said light source thereby allowing the charge level on said charge retentive member to increase above said predetermined level;

controlling developer structure such that contact between the developer material and said charge retentive member is prevented until a second predetermined voltage level, substantially greater than said first predetermined voltage level, on said charge retentive member has been reached.

2. The method according to claim 1 wherein said step of controlling a developer structure comprises rotating a magnetic roll structure in a first direction.

3. The method according to claim 2 including the step of rotating said magnetic roll structure in the opposite direction after said charge retentive member has reached said second predetermined level whereby developer material is brought into contact with latent images on said charge retentive member.

4. The method according to claim 2 wherein said step of controlling developer structure comprises rotating a pair of magnetic roll structures in a first direction.

5. The method according to claim 4 including the step of rotating said pair of magnetic roll structures in the opposite direction after said charge retentive member has reached said second predetermined level whereby developer material is brought into contact with latent images on said charge retentive member.

6. The method according to claim 1 further including the steps of:

terminating the formation of latent images;

decreasing the intensity of said light source to said first predetermined voltage level;

controlling said developer structure such that contact between the developer material and said charge retentive member is prevented during the decreasing of the intensity of said light source.

7. The method according to claim 1 wherein said step of controlling a developer structure comprises controlling two developer housings.

8. The method according to claim 7 wherein said step of controlling developer structure comprises rotating a magnetic roll structure in each of said housings in a first direction.

9. The method according to claim 8 including the step of rotating each of said magnetic roll structures in the opposite direction after said charge retentive member has reached said second predetermined level whereby developer material is brought into contact with latent images on said charge retentive member.

10. The method according to claim 9 wherein said step of controlling developer structure comprises rotating a pair of magnetic roll structures in each of said housings in a first direction.

11. The method according to claim 10 including the step of rotating each pair of said magnetic roll structures in the opposite direction after said charge retentive member has reached said second predetermined level whereby developer material is brought into contact with latent images on said charge retentive member.

12. The method according to claim 11 further including the steps of:

terminating the formation of latent images;

decreasing the intensity of said light source to said first predetermined voltage level;

controlling said developer structure such that contact between the developer material and said charge retentive member is prevented during the decreasing of the intensity of said light source.

13. Apparatus for forming images on a charge retentive surface, said apparatus comprising:

a supply of developer;

at least one pair of magnetic roll structures including an outer shell supported for rotation and spaced a predetermined distance apart;

means for effecting rotation of said rolls in first and second directions;

said magnetic roll structures being of a predetermined diameter and having a magnetic field profile and spacing between said at least one pair of magnetic roll structures whereby rotation thereof in one of said directions effects efficient application of developer to said charge retentive surface and rotation in the opposite direction prevents developer material from contacting said charge retentive surface.

14. Apparatus according to claim 13 including a second pair of magnetic roll structures identical in construction to said at least one pair of magnetic rolls and adapted to apply developer of a different color from that applied by said at least one pair of magnetic rolls and wherein said means for effecting rotation also effects rotation of said second pair of magnetic roll structures in first and second directions.

15. Apparatus according to claim 14 wherein said rotation effecting means is adapted to rotate said at least one pair of magnetic rolls and said second pair of magnetic rolls in opposite directions at the same time.

16. Apparatus according to claim 13 including:

means for uniformly charging a charge retentive member;

means for actuating a light source for uniformly discharging said charge retentive member and selectively discharging said charge retentive member in accordance with information to be produced;

means for causing said light source to uniformly discharge said charge retentive member to a first predetermined voltage level;

means for decreasing the intensity of said light source thereby allowing the charge level on said charge retentive member to increase above said predetermined level;

wherein said magnetic roll structures are rotated in said opposite direction until said predetermined charge level is attained.

17. Apparatus according to claim 16 further including:

means for terminating the formation of latent images;

means of decreasing the intensity of said light source to said first predetermined voltage level;

means of rotating said pair of magnetic roll structures in said opposite direction so that contact between the developer material and said charge retentive member is prevented during the decreasing of the intensity of said light source.

18. Apparatus according to claim 16 including a second pair of magnetic roll structures identical in construction to said at least one pair of magnetic roll structures, said second pair of magnetic roll structures being provided for applying a different color developer to said charge retentive surface from said at least one pair of magnetic roll structures.

19. Apparatus according to claim 18 wherein rotation of one pair is terminated while rotation of the other pair is continued.

20. Apparatus for forming images on a charge retentive surface, said apparatus comprising:

a supply of developer;

at least one pair of magnetic roll structures including an outer shell supported for rotation and spaced a predetermined distance apart;

means for effecting rotation of said rolls in first and second directions;

said magnetic roll structures having magnetic field force profiles whereby rotation thereof in one of said directions effects movement of developer from one of said magnetic roll structures to the other and application of developer to said charge retentive surface, and rotation in the opposite direction prevents developer material from contacting said charge retentive surface and prevents movement of developer from said one of said magnetic roll structures to said other of said magnetic roll structures.

21. Apparatus according to claim 20 including a second pair of magnetic roll structures identical in construction to said at least one pair of magnetic rolls and adapted to apply developer of a different color from that applied by said at least one pair of magnetic rolls and wherein said means for effecting rotation also effects rotation thereof in first and second directions.

22. Apparatus according to claim 21 wherein said rotation effecting means is adapted to rotate said at least one pair of magnetic rolls and said second pair of magnetic rolls in opposite directions at the same time.

23. Apparatus according to claim 22 including:

means for uniformly charging a charge retentive member;

means for actuating a light source for uniformly discharging said charge retentive member and selectively discharging said charge retentive member in accordance with information to be produced;

means for causing said light source to uniformly discharge said charge retentive member to a first predetermined voltage level;

means for decreasing the intensity of said light source thereby allowing the charge level on said charge retentive member to increase above said predetermined level;

wherein said magnetic roll structures are rotated in said opposite direction until said predetermined charge level is attained.

* * * * *